US010240448B2

(12) United States Patent
Kuehl et al.

(10) Patent No.: US 10,240,448 B2
(45) Date of Patent: Mar. 26, 2019

(54) SMART FRAC PLUG SYSTEM AND METHOD

(71) Applicants: Dillon W Kuehl, Bandera, TX (US); Charles M Williams, Weatherford, TX (US); Josiah J Leverich, San Antonio, TX (US)

(72) Inventors: Dillon W Kuehl, Bandera, TX (US); Charles M Williams, Weatherford, TX (US); Josiah J Leverich, San Antonio, TX (US)

( * ) Notice: Subject to any disclaimer, the term of this patent is extended or adjusted under 35 U.S.C. 154(b) by 496 days.

(21) Appl. No.: 14/876,121

(22) Filed: Oct. 6, 2015

(65) Prior Publication Data

US 2016/0097269 A1 Apr. 7, 2016

Related U.S. Application Data

(60) Provisional application No. 62/060,624, filed on Oct. 7, 2014.

(51) Int. Cl.

| | |
|---|---|
| ***E21B 43/267*** | (2006.01) |
| ***E21B 47/06*** | (2012.01) |
| ***E21B 49/08*** | (2006.01) |
| ***E21B 47/00*** | (2012.01) |
| ***E21B 33/129*** | (2006.01) |
| ***E21B 43/26*** | (2006.01) |

(52) U.S. Cl.

CPC ..... *E21B 43/267* (2013.01); *E21B 33/1294* (2013.01); *E21B 43/26* (2013.01); *E21B 47/0002* (2013.01); *E21B 47/06* (2013.01); *E21B 47/065* (2013.01); *E21B 49/087* (2013.01)

(58) Field of Classification Search

CPC .... E21B 33/1294; E21B 43/26; E21B 43/267; E21B 47/0002; E21B 47/06; E21B 47/065; E21B 49/087; E21B 33/12

See application file for complete search history.

(56) References Cited

U.S. PATENT DOCUMENTS

| | | | | |
|---|---|---|---|---|
| 5,191,939 | A * | 3/1993 | Stokley | E21B 19/00 166/187 |
| 2002/0157828 | A1* | 10/2002 | King | E21B 33/16 166/285 |
| 2006/0102342 | A1* | 5/2006 | East | E21B 43/26 166/250.1 |

(Continued)

*Primary Examiner* — Caroline N Butcher

(74) *Attorney, Agent, or Firm* — Fish & Richardson P.C.

(57) ABSTRACT

A frac plug system for use at the end of well drill string in a fractured underground formation, including an elongated mandrel body, a nose cone, a mandrel head, and a sealing assembly; at least one sensor positioned on the nose cone, the sensor being optionally a temperature sensor, pressure sensor, pH sensor, or fluid composition sensor; a battery operated microcontroller located in the mandrel body, the microcontroller constructed and arranged to periodically read the data output of the sensor and store the data from the sensor; a transmitter constructed and arranged to transmit the stored data from the set of sensors to a receiver on a pup joint when the receiver is in receiving range of said transmitter, the receiver constructed and arranged to write the transmitted stored data to an electronic memory; and whereby the data may be retrieved from the electronic memory.

18 Claims, 3 Drawing Sheets

(56) References Cited

U.S. PATENT DOCUMENTS

| | | | | |
|---|---|---|---|---|
| 2008/0115574 | A1* | 5/2008 | Meek | E21B 17/10<br>73/152.03 |
| 2010/0163224 | A1* | 7/2010 | Strickland | E21B 33/12<br>166/254.1 |

* cited by examiner

SMART FRAC PLUG SYSTEM AND METHOD

CROSS REFERENCE TO RELATED APPLICATION

This application claims the benefit of Provisional U.S. Patent Application Ser. No. 62/060,624, filing date Oct. 7, 2014.

STATEMENT REGARDING FEDERALLY FUNDED RESEARCH AND DEVELOPMENT

The invention described in this patent application is not the subject of federally sponsored research or development.

FIELD

The present disclosure pertains to frac plugs; more particularly, the present disclosure pertains to frac plugs inserted into an underground formation in which fractures have been formed to enable fluids, particularly hydrocarbons, contained in an underground reservoir to flow into a well bore.

BACKGROUND

In recent years it has been discovered that underground fluids, particularly hydrocarbons, can be extracted from underground reservoirs if underground fractures are created near the hydrocarbons to enable the hydrocarbons to pass through the underground fractures into a well bore where the hydrocarbons may be brought to the top of the well bore.

Once the underground fractures have been created, there is a need to keep the underground fractures open. Various systems, to include the injection of fluids and solids into the fractures, have been used to keep the underground fractures open.

One method of keeping fractures open is the use of free standing frac plugs. One example of such a free standing frac plug appears in U.S. Pat. No. 8,336,616.

As more and more formations are being opened up using fracturing techniques, there has been a greater demand for frac plugs. Specifically, there is a need for frac plugs sized and shaped to provide greater maneuverability and reduced time for placement within and removal from a fracture. As more frac plugs are being used, there is also a greater need to keep track of the movement and location of the frac plugs within the underground fractures. In addition, those managing well operations at the top of a well continually seek additional down hole data which will enable the more efficient production of hydrocarbons from a well.

SUMMARY

The disclosed smart frac plug of the present invention has a shortened body, a radio frequency identifying system, and sensors enabling the transmission of data regarding underground well conditions to those managing well operations at the wellhead.

More particularly, the disclosed invention is a frac plug system and method for use at the end of a drill string in a well within a fractured underground formation, comprising:

an elongated mandrel body, wherein the front portion of said elongated mandrel body includes a nose cone, the rear of said elongated mandrel body includes a mandrel head and the mid-portion of said elongated mandrel body includes a sealing assembly;

a set of sensors positioned on said nose cone, said set of sensors being selected from a group including: temperature sensors, pressure sensors, pH sensors and fluid composition sensors;

a battery operated microcontroller located within said mandrel body, said battery operated microcontroller constructed and arranged to periodically read the data output of said set of sensors and store said data from said set of sensors;

a transmitter electrically connected to said battery operated microcontroller, said transmitter constructed and arranged to transmit said stored data from said set of sensors to a receiver when said receiver is in receiving range of said transmitter, said receiver constructed and arranged to write said transmitted stored data to an electronic memory;

whereby when said data from said set of sensors may be retrieved from said an electronic memory.

BRIEF DESCRIPTION OF THE DRAWING FIGURE

A still better understanding of the disclosed smart frac plug system and method may be had by reference to the drawing figures wherein.

DESCRIPTION OF THE EMBODIMENTS

The frac plug 10 used in the disclosed smart plug system and method has the general shape of a bullet. The pointed end or front portion 12 of the generally bullet shaped smart frac plug 10 enters the well bore first. The blunt or rear portion 14 of the generally bullet shaped smart frac plug 10 receives the force necessary to move the smart frac plug 10 into a desired position within underground fracture.

Figure 1:
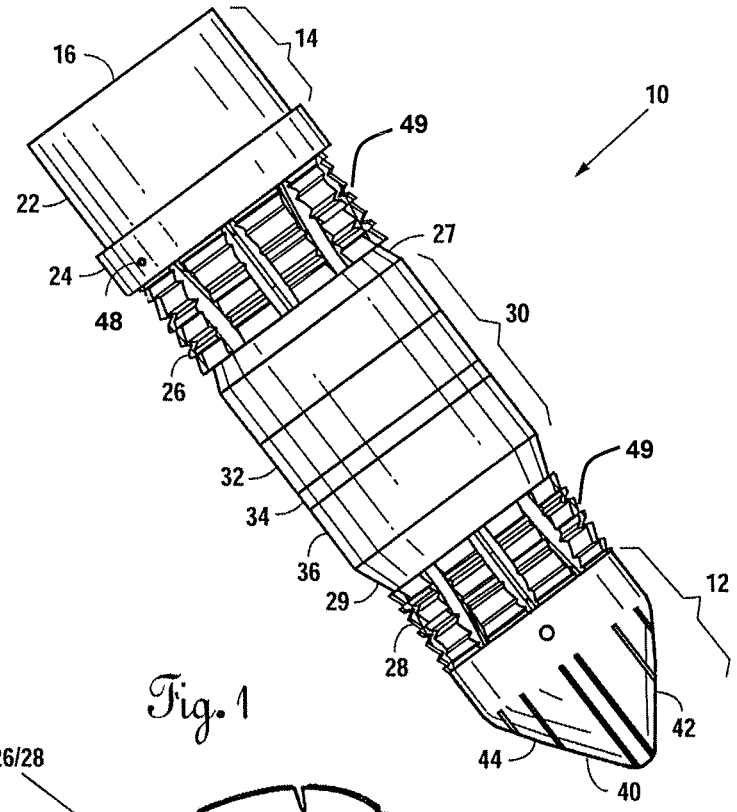
FIG. 1 is a side elevation view of the frac plug of the present invention.

As will be seen in FIG. 1, the rear portion 14 of the smart frac plug 10 has a substantially squared top mandrel head 22. The mandrel head 22 can include a threaded or pinned capability. Above the substantially squared top mandrel head 22 is a slip initiator ring 24, sometimes called a load ring. The ring 24 is typically made from a composite material.

Figure 1A:
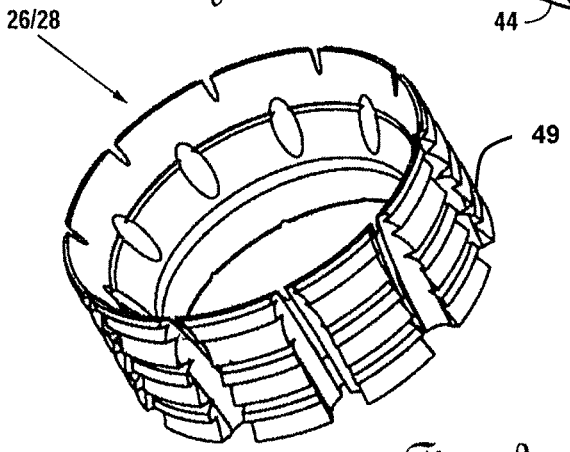
FIG. 1A is a perspective view of the slip cones.

The slip initiator ring 24 engages a first composite or metal slip cone 26 (FIG. 1A) which surrounds the body of the smart frac plug and provides support for the mandrel or body portion 16 of the smart frac plug 10 enabling the rear portion 14 of the smart frac plug 10 to withstand forces of up to about 15,000 pounds. The surface of the first composite or metal slip 24 includes projections 49 extending therefrom. The first composite or metal slip ring 24 engages a first slip cone 26. Force from the slip initiator ring causes the first composite slip to move over the first slip cone 26. It is the first slip initiator ring 24 and the second slip 28 (FIG. 1A) described below, which set the position of the disclosed smart frac plug 10 within the well bore.

Adjacent to the first slip cone 26 is a seal assembly 30 constructed and arranged to withstand contact with both sour gas and high temperatures. The seal assembly 30 can be an elastomeric or similar seal. In the preferred embodiment shown in FIG. 1, the seal assembly 30 includes first hard rubber ring 32. The hardness of this first hard rubber ring 32 is approximately 90 durometer. Adjacent to the first slip cone 26 is a composite separator ring 34. Adjacent to the composite separator ring 34 is a second hard rubber ring 36. The hardness of this second hard rubber ring 36 is approximately 80 durometer.

The second metal or composite slip cone 29 is positioned next to the second hard rubber ring 36. Like the first slip cone 26, the second slip 28 engages a second slip cone 29. Like the first slip cone 26, the surface of the second slip 28 includes projections 49 extending therefrom.

On the front of the smart frac plug 10 is a nose cone 40. The nose cone 40 may be beveled to have sides 42, 44 approximately 45 degrees from the long axis of the smart frac plug 10. In the preferred embodiment, the end of the nose cone 40 is approximately ½ inch wide. Other shapes of the nose cone 40 may be used to engage the underground formation so that the smart frac plug 10 will lock in place and drill out faster in the well bore.

The overall length of the preferred embodiment of disclosed smart frac plug 10 is about 16 inches to decrease the drill out time and increase the mobility of the smart frac plug in the dog legs of a well bore. Depending on the size of the fractures and the type of underground formation in which the fractures are made, the disclosed frac plug 10 may be made shorter or longer.

It has been found that the disclosed frac plug 10 may be made from a variety of ferrous metals; however, use of a G2 cast iron or equivalent has provided the best results.

In an alternate embodiment the second slip cone 29 can be positioned adjacent the second slip 28 at the end of smart frac plug 10 nearest the nose cone 40.

In another alternate embodiment, the first slip cone 26 can be disposed adjacent to the first slip 24. The slip cones in the alternate embodiments may include one or more rings to provide an even distribution of axial forces on the seal portion in the middle of the smart frac plug between the first slip and the second slip.

As shown in FIG. 1, a radio frequency identification device 48 is positioned in the mandrel portion of the smart frac plug 10 in an area near the slip initiator ring 24. Such radio frequency identification devices are particularly useful when multiple smart frac plugs 10 are used in large underground fractures.

Also located within the mandrel portion 16 of the smart frac plug 10 is a space (not shown) for containing a package containing the necessary electronic componentry for supporting the translation of electronic signals received from a set of sensors 50 located on the smart frac plug 10 and converting the reading of these sensors into electronic signals. Such set of sensors 50 will include but not be limited to sensors for detecting wire line tension, temperature, pressure, pH, velocity of travel of the frac plug 10, vertical depth, time of sensing, and rate of pump down. If needed, a camera may be placed in or near the nose cone 40 for transmission of visual images of down hole conditions.

The data received from the set of sensors 50 or camera will include identifying information from the smart frac plug 10. Further, the electronic componentry on the smart frac plug 10 will enable the collection of data received by the set of sensors 50. Such data collection ability will include commands which may be executed by a data collection agent on a distributed device or a similar device. The data to be collected and the conditions under which the data is collected and/or transmitted enable the data collection agent to execute the collection of data on demand and transform the collected data into a metrics package, which metrics package may then be sent to a data storage facility for later use.

Figure 2:
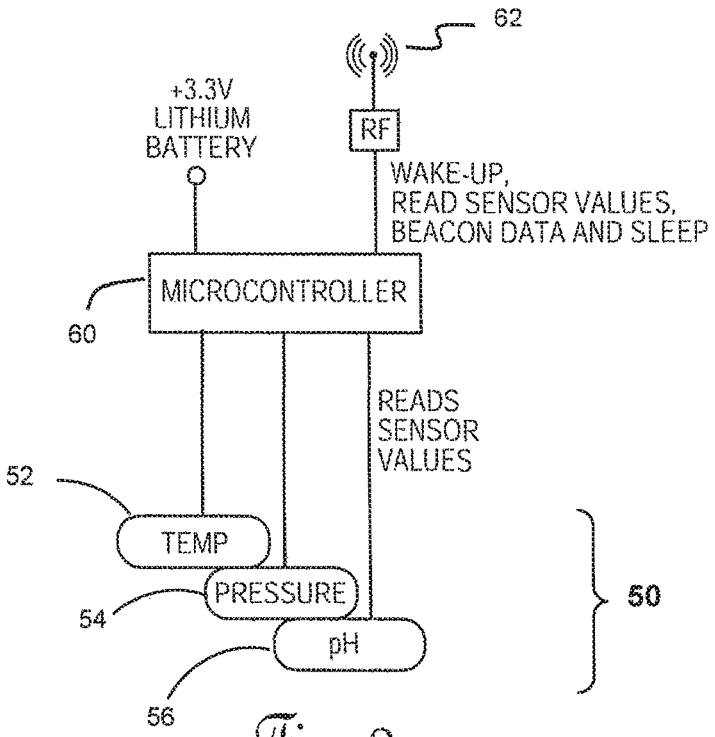
FIG. 2 is a schematic of the sensor data transmission package carried by the frac plug shown in FIG. 1 into the well bore.

As shown in FIG. 2, the frac plug 10 will include a set of sensors 50 such as sensors enabling the production of electrical signals in response to the temperature 52, the pressure 54, and the pH 56 of any fluid at the front surface of the frack plug 10.

The frac plug 10 battery operated microcontroller 60 will also include a memory to periodically store and date/time stamp the electrical signals produced by the set of sensors 50. The microcontroller 60 will organize the sensed data and put it into a format which may be transmitted. In addition, the frac plug 10 will continuously send a signal 62 searching for the presence of a receiver 70.

Figure 3:
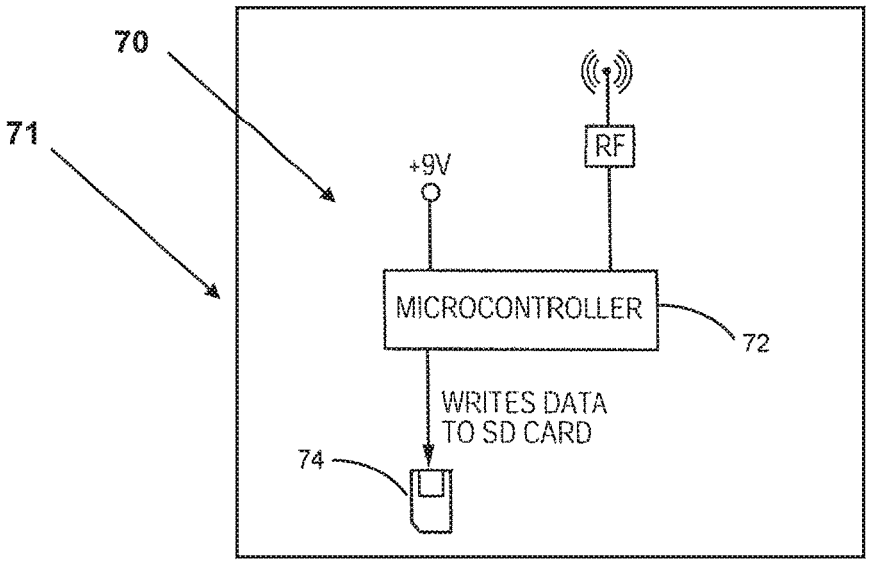
FIG. 3 is a schematic of the sensor data receiver package contained within the pup joint portion of the drill string.

When a receiver assembly 70, as shown in FIG. 3, is sensed by the microcontroller 60 within the frac plug 10, the data stored within the microcontroller 60 will be transmitted to the receiver assembly 70 within the pup joint 71 at the end of the drill string (not shown). The transmitted data will be uploaded into an electronic memory 74, such as an SD card, electronically connected to a battery operated microcontroller 72 within the receiver assembly 70. When the drill string and pup joint are removed from the well bore, the electronic memory 74 may be removed to review the conditions within the well sensed by the set of sensors 50 at the front of the frac plug 10.

Figure 4:
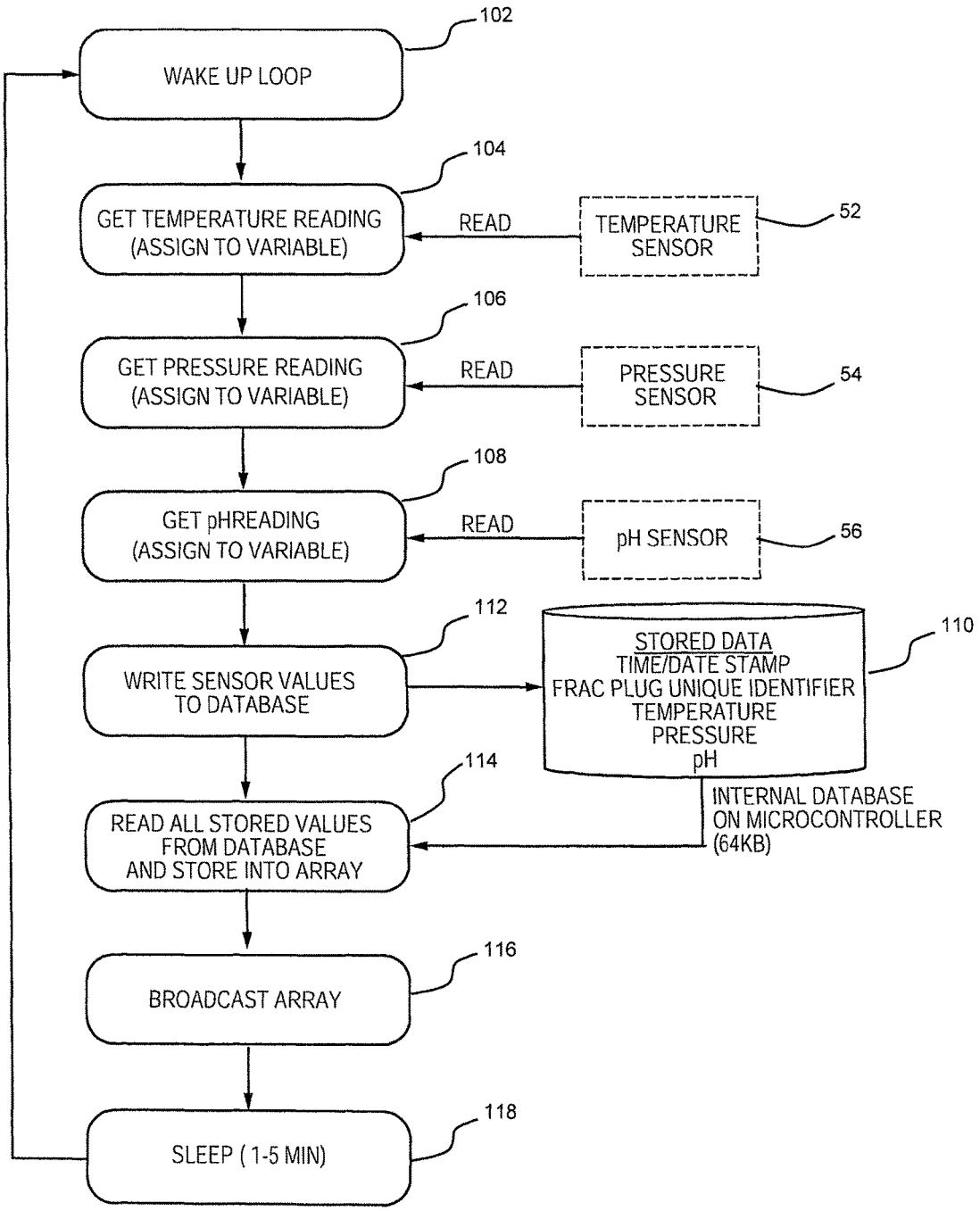
FIG. 4 is a flow chart of the operation of the sensor data transmission package shown in FIG. 1.

A still better operation of the frac plug 10 shown in FIG. 2 may be had from the flow chart shown in FIG. 4. Therein it may be seen that periodically the process of gathering data is initiated 102. In the first step, data regarding temperature is recorded 104. In the second step, data regarding pressure is recorded 106. In the third step, data regarding pH is recorded 108. This set of data is put together with a data/time stamp and an identifier 110 for the frac plug 10 when it is written 112 and stored 114 in a data base.

If a receiver assembly 70 is close, the recorded and stored data will be broadcast 116 to the receiver assembly 70 in a nearby pup joint. If not, the set of sensors 50 will await a signal 118 from the microcontroller 72 to once again collect data. When this signal is produced by the microcontroller 72, the process is repeated. Such signals may be produced at intervals from about 1 minute to about 5 minutes.

While the present disclosure has been explained according to its preferred any alternate embodiments, those of ordinary skill will understand that variations and improvements may be made. Such variations and improvements shall be included with the scope and meaning of the appended claims.

What is claimed is:

1. A frac plug system for use at the end of well drill string in a fractured underground formation, said frac plug system comprising:

an elongated mandrel body, wherein the front portion of said elongated mandrel body includes a nose cone, the rear of said elongated mandrel body includes a mandrel head and the mid-portion of said elongated mandrel body includes a sealing assembly;

at least one sensor positioned on said nose cone;

a battery operated microcontroller located within said mandrel body, said battery operated microcontroller constructed and arranged to periodically read data output of said at least one sensor and store said data from said at least one sensor;

a transmitter electrically connected to said battery operated microcontroller, said transmitter constructed and arranged to transmit said stored data from said at least one sensor to a receiver configured to be located in a pup joint when said receiver is in receiving range of said transmitter, said receiver constructed and arranged to write said transmitted stored data to an electronic memory;

whereby said data from said at least one sensor may be retrieved from said electronic memory.

2. The frac plug system as defined in claim 1 wherein said sealing assembly includes a pair of slips and slip cones.

3. The frac plug system as defined in claim 1 wherein the data output of said at least one sensor gathers information from about one minute intervals to about 5 minute intervals.

4. The frac plug system as defined in claim 1 wherein the data output of said at least one sensor includes an indication of the date and time that the information was gathered.

5. The frac plug system as defined in claim 1 wherein the transmission from said transmitter further includes an electronic identification of the frac plug on which said at least one sensor is mounted.

6. The frac plug system as defined in claim 1 wherein said receiver and said electronic memory are located in a pup joint at the end of the drill string.

7. The frac plug system as defined in claim 1 wherein said at least one sensor may also include at least one sensor selected from the group consisting of sensors providing information regarding: frac plug position, wire line tension, well depth, frac plug travel velocity, and a visual image of the formation.

8. The frac plug system as defined in claim 1 wherein said elongated mandrel body is made from cast iron.

9. The frac plug system as defined in claim 1 wherein the at least one sensor is selected from the group consisting of a temperature sensor, a pressure sensor, a pH sensor, and a fluid composition sensor.

10. The frac plug system as defined in claim 1 wherein the at least one sensor is a pH sensor.

11. The frac plug system as defined in claim 1 wherein the at least one sensor is a fluid composition sensor.

12. A method of gathering data about conditions in a fractured formation surrounding a well bore using a frac plug comprising:

periodically gathering electrical signals representative of the conditions sensed by at least one sensor located in the frac plug;

writing the gathered electrical signals into a data base along with an identification of the frac plug gathering said gathered electrical signals and the data and time that said gathered electrical signals were gathered;

transmitting said gathered electrical signals to a receiver located in a pup joint; and removing said pup joint from the well bore.

13. The frac plug system as defined in claim 12 wherein the at least one sensor is selected from the group consisting of a temperature sensor, a pressure sensor, a pH sensor, a position sensor, a velocity sensor, and a visual sensor.

14. The frac plug system as defined in claim 12 wherein the at least one sensor is a pH sensor.

15. The frac plug system as defined in claim 12 wherein the at least one sensor is a fluid composition sensor.

16. The frac plug system as defined in claim 12 wherein the at least one sensor is a position sensor.

17. The frac plug system as defined in claim 12 wherein the at least one sensor is a velocity sensor.

18. The frac plug system as defined in claim 12 wherein the at least one sensor is a visual sensor.

* * * * *